United States Patent [19]

Corrigan

[11] 4,100,682

[45] Jul. 18, 1978

[54] TREATMENT OF COMMODITIES THROUGH CONTACT WITH FLUID MEDIA

[76] Inventor: John H. Corrigan, 62 Judith Rd., Emmarentia, Johannesburg, Transvaal, South Africa

[21] Appl. No.: 672,316

[22] Filed: Mar. 31, 1976

[30] Foreign Application Priority Data

Apr. 10, 1977 [ZA] South Africa ..... 77/1844

[51] Int. Cl.[2] ..... F26B 3/04

[52] U.S. Cl. ..... 34/22; 34/38; 34/196; 34/212; 34/216; 34/217; 99/449; 99/483

[58] Field of Search ..... 34/212, 213, 216, 217, 34/195–197, 22, 38; 138/119, 121; 426/465; 99/416–418, 449, 483; 432/128, 133, 164, 167, 169

[56] References Cited

U.S. PATENT DOCUMENTS

| | | | |
|---|---|---|---|
| 502,237 | 7/1893 | Proctor | 34/196 |
| 986,602 | 3/1911 | Stare | 34/196 |
| 1,532,097 | 3/1925 | Allsop et al. | 34/196 |
| 2,293,316 | 8/1942 | Stebbins | 34/196 |
| 2,294,530 | 9/1942 | Wiese | 34/196 |
| 2,370,422 | 2/1945 | Reed | 34/196 |
| 2,625,872 | 1/1953 | Follansbee et al. | 138/121 |
| 3,264,004 | 8/1966 | Sciaky | 34/242 |
| 3,299,532 | 1/1967 | Melikian | 34/195 |
| 3,367,043 | 2/1968 | Torigan | 34/197 |

FOREIGN PATENT DOCUMENTS

| | | | |
|---|---|---|---|
| 202,925 | 8/1923 | United Kingdom | 34/196 |

*Primary Examiner*—John J. Camby
*Assistant Examiner*—Larry I. Schwartz
*Attorney, Agent, or Firm*—Murray and Whisenhunt

[57] ABSTRACT

The present invention relates to a method and apparatus for subjecting commodities to treatment through contact with fluid media including a plurality of movable conveyances having walls and being arranged so as to form a conveyance train which forms a part of a single endless fluid conveying duct.

12 Claims, 2 Drawing Figures

TREATMENT OF COMMODITIES THROUGH CONTACT WITH FLUID MEDIA

Figure 2:
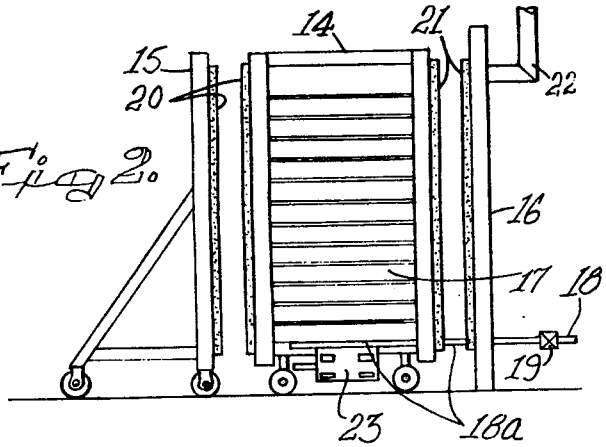

This invention relates to the treatment of commodities and articles generally through contact with fluid media.

The invention is particularly concerned with the treatment of foodstuffs through contact with drying air, smoke laden air, sulphur vapour, steam and the like.

In one particular aspect to which the present invention relates, the drying of foodstuffs such as vegetables, it is traditional to use what are known as drying tunnels. Where drying tunnels are employed somewhat large masonry structures are provided in which trains of trolleys carrying the material to be treated are advanced according to predetermined drying schedules with air currents flowing according to prescribed patterns and having the necessary drying characteristics. These conventional drying tunnels are known to have many defects quite apart from the space occupied thereby. In a well known book on the subject entitled "FOOD DEHYDRATION" by Wallace B. van Arsdel, the following extract appears with reference to drying tunnels:-

"Great care is exercised to get an accurately level track through the tunnel, so as to facilitate movement of the trucks, but it should not be forgotten that the air current itself produces a considerable force on the string of trucks, making it necessary to chock the wheels at th downstream end. Accurate framing of tunnel walls and roof is also necessary in order to maintain the minimum free opening around the stack of trays, generally not more than about 2 inches clearance all round".

Quite apart from the difficulties outlined in this quotation other problems inherent in the use of drying tunnels made of bricks, blocks and the like are the following:-

(a) The passage of heated air over plasterwork, concrete and the like has a drying effect which under normal conditions may give rise to crumbling and the creation of dust in the tunnel.

(b) The drying out mentioned under (a) frequently affects the ground under a tunnel with the consequent danger of shrinkage and foundation shift, wall cracking and the like. Wall cracking carries with it the problem of leaks of conditioned air and the like from the tunnel. In the case of blast freezing, the heat leakage through the floor is always a serious problem and requires bonding of the insulation under the floor to minimise this difficulty.

(c) Drying out also has a tendency to open up leaks around door frames and doors through which the trolleys pass on entering or leaving the tunnel. Doors inherently are difficult to maintain air-tight and the shrinkage resulting from constant drying can give rise to leakage on a considerable scale.

(d) When return ducts for the airstream are also made of brickwork the loss of pressure can become considerable with consequent increases in fan horsepower needed to perform the necessary task efficiently.

(e) The use of tunnels, with their basic need for fine clearance between trolleys and tunnel sides, brings in very great difficulties in examining the drying or other process as it may be progressing in a tunnel at any stage of a trolley train. Generally the tunnel has to be opened up and the trolleys removed for examination.

(f) Generally when a trolley at the head of a train thereof is to be removed on completion of the process in question, it is effected from one end of the tunnel and all the other trolleys have to be moved up one place to permit the introduction of a fresh trolley. This is laborious and time-consuming.

(g) It is fundamental to the efficient operation of a tunnel that the all round clearance between the trolleys and the tunnel walls should be minimal. However, from a practical point of view it must be taken into account that trolleys tend to bunch and be slightly out of alignment at their meeting points. Hence allowance must be made with the result that the actual clearance gives rise to an enlarged free air space in which no work is done.

(h) The manual movement of trolleys results in the trolleys often being brought violently into engagement and this can create a dust problem.

(i) The penetration of volatiles into brickwork and concrete floors is serious.

The above are but some of the problems arising with tunnels as currently in use and will suffice to emphasise that there is room for developments in this art.

An object of the current invention is the provision of a method and means for carrying out the method which the applicant believes should prove an adequate substitute for the tunnel arrangement described above in many if not most processes in which the tunnel finds application.

According to the present invention the articles or commodities are located for treatment in a conveyance which itself constitutes or forms part of a substantially sealed duct or chamber in which the process to which the commodities are to be subjected takes place in whole or in part.

Further according to the invention the duct is built up by employing a plurality of conveyances which are linked together in a train in such relationship that their abutting faces are adapted to make substantially sealed engagement.

Preferably the conveyances are supported on their own wheels but movement of these conveyances may be achieved in any suitable manner.

Location of the commodities or articles in the conveyances may be achieved through the use of trays or the like or they may be suspended from rods, rails or the like.

In one form of the invention the conveyances are linked in a train which provides part of a generally endless closed duct for the passage of, say, drying air which is circulated within the duct through the use of suitable driers, fans and the like.

The closed duct is preferably characterised in two fixed separated stations at one of which a suitable circulation fan and burner is located while at a removed point a terminal station is provided. Between these stations a train of trolleys is located and circulating drying air is admitted at the burner or other suitable heat source station for movement through the trolleys and removal therefrom at the terminal end.

Preferably the arrangement of the invention includes means which are expandable or retractable at the stations for facilitating the removal of unit conveyances from the train and their replacement with fresh conveyances. In some forms of the invention an endless duct may not be required and in such cases the open ended conveyance or train thereof is held against blank sealing walls as the occasion may require. Thus where blanching, smoking or sulphuring is involved means is provided to admit the required fluid medium into the zone bounded by the walls of the conveyance and means, preferably towards the top of at least one of the blank walls, acts to draw off such fluid when it has performed its task.

Figure 1:
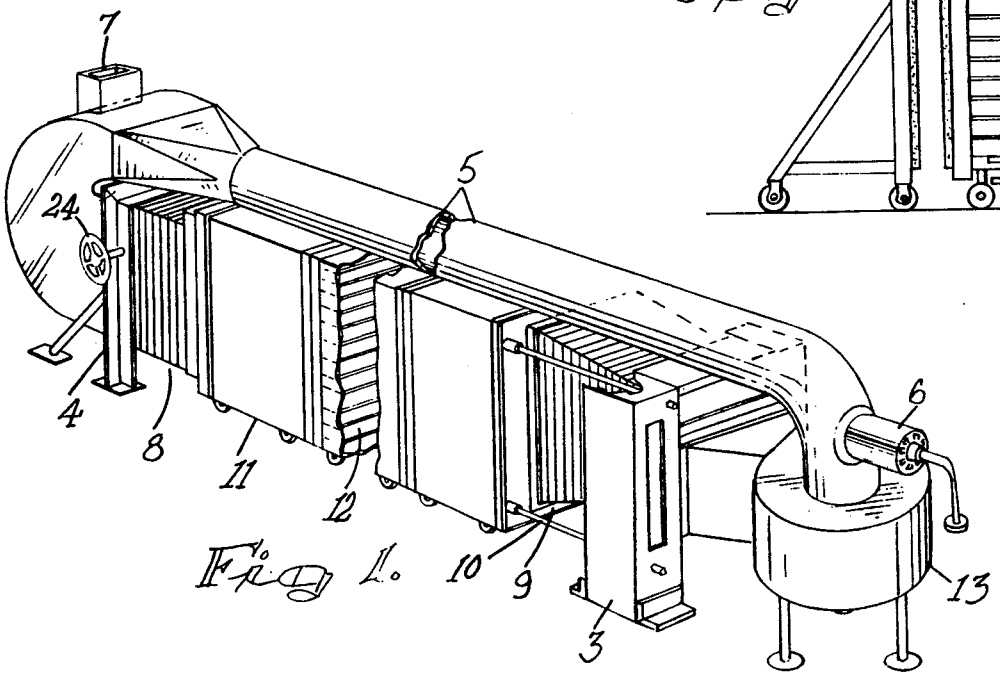

The invention is directed to the method of treating commodities and to the novel apparatus involved therein and the above and other aspects of the invention are amplified in the description set out below of various embodiments with reference to the accompanying drawings in which:

FIG. 1 is a perspective view of a drying arrangement according to the invention; and FIG. 2 is a side view of a steam blanching unit according to the invention.

Dealing firstly with arrangements of the invention employing equipment as shown or substantially as shown in FIG. 1. In this case the intention is to provide for the drying of all manner of articles which hitherto relied principally upon drying tunnels for achieving this purpose.

The equipment includes a unit which provides a fixed heat source station 3, a terminal station 4, a closed duct 5 between the two stations, a burner heat source unit 6, an exhaust 7 for wet air, a retractable and expandable bellow mouth 8 at the terminal station 4, a similar bellows mouth 9 at the heat source station 3 and buffer means 10 for purposes which will become apparent as the description proceeds.

Between stations 3 and 4 a series of conveyances 11 is coupled in a train thereof and each of these conveyances provide a plurality of drying trays 12 for accommodating articles or commodities to be dried. The peripheries of the conveyances are insulated in a suitable manner and meeting faces of the conveyances are provided with sealing means such that when conveyances are brought into abutting relationship in a train the escape of the drying medium is at least largely inhibited. Mechanical locking means may also be employed to form adequate coupling of the individual elements in the train.

It will be appreciated that in an operation such as is the subject of the present description the question of lagging and insulation form only an incidental part of the invention proper and the manner of the insulation employed may largely be a matter of choice.

For drying, say, vegetables, the commodities are laid out on the trays of the conveyances or trolleys 11 and the trolleys are keyed in a train as shown in FIG. 1. The engagements between the trolleys and between the trolleys and the end bellows are intended to be substantially air-tight and the hot air provided by the burner or other suitable heat source is forced progressively through the trolleys by the circulating fan 13 from the direction of the first or burner station to the terminal station and thence along the return duct 5 towards the burner zone.

In the arrangement of the invention the first trolley in which the drying process would have reached finality is that trolley nearest the terminal station 4. By retracting bellows 8 by hand-controlled wheel 24 this trolley may be withdrawn from the train. To replace the trolley with a trolley carrying fresh material for treatment the bellows 8 are brought forward manually to the locked position and the bellows 9 are mechanically withdrawn to their full extent by four buffers 10 and the fresh trolley is inserted in the space thus provided. The buffers 10 then move the whole train forward thus expanding bellows 9 until the leading trolley is in contact with station 4 and bellows 8 when the operation is restarted.

The entire process of opening up and closing the bellows, the required movements of the buffers 10 and the general operation of the burner and circulating fan may all be automatised and synchronised so that a virtual 'push button' device is provided.

Clearly the device and process described with reference to FIG. 1 may be varied in many respects without materially departing from the general concept of providing a drying arrangement which dispenses with the need for the conventional drying tunnel through which trains of drying trolleys are urged in the course of drying operations.

It will be evident that inspection of the interior of a trolley 11 at any point in the train may be accomplished without undue difficulty and in any event the provision of removable plugs or the like in each trolley for the insertion of thermometers or for shielding peep holes presents no constructional problems.

To facilitate the manoeuvring of the trolleys in the course of exercising the method of the invention a preference may be placed on the use of castor type wheels.

Drying in accordance with the method and equipment of the invention may be performed on many different types of articles and commodities. Vegetables, fruit and the like readily suggest themselves for use in the process but the applicant believes that certain ceramics, bricks, cotton materials and other articles could also be subjected to drying, curing, baking or humidifying by this method.

In FIG. 2 a modification of the invention is illustrated in diagrammatic form.

Where, for example, steaming of vegetables is needed, a process referred to in the art as blanching, the trolley 14 forms the steaming duct with its open ends closed by walls 15 and 16. Drawing 2 is intended to show the trolley 14 with its side facing the viewer removed and the reference 17 indicates trays disposed in the interior of the trolley. Wall 16 is a fixture while wall 15 is mounted on wheels to enable it to be moved sufficiently to allow the process to be repeated on trolley after trolley without the need to unload and reload a particular trolley when steaming is complete.

Steam enters the interior of the trolley 14 through steam supply pipe 18 which is preferably branched in that zone which is located at low level in the trolley when steaming is taking place. The portion **18*a* of pipe 18 projects from wall 16 at a height such that when the trolley is urged into engagement with wall 16** it enters the trolley beneath the lowermost tray.

Before turning on the steam at valve 19 the wall 15 is pushed up against the trolley to the extent that adequate seals are established at points 20 and 21. Steam enters at low level, mixing with any necessary air introduced through burner sump 23, rises through the trolley and leaves through the exhaust 22.

The trolley 14 shown in FIG. 2 is also adapted for use where, say, sulphuring of commodities is required. Sulphur is burnt in the burner 23 and after passing upwardly in the trolley leaves again at the exhaust 22.

Smoking may also be achieved using burner 23 or by admission of the smoke through pipe-line 18. Smoking may also be effected with the equipment shown in FIG. 1 where smoke could be introduced at the burner entry.

Where blast freezing is to be carried out equipment substantially akin to that shown in FIG. 1 would be suitable save for the replacement of the burner by a freezer or other suitable cold source.

The equipment may be used in a type of parallel operation or counterflow conditions may be set up with modifications to the apparatus which in themselves should present no substantial technical problems.

The essence of the invention is the elimination of special tunnels in which the trolleys equivalent to those shown by the references 11 and 14 are located during the operation in question.

In yet a further example of the invention equipment which in principle varies little from that shown in FIG. 1 is used to dry and kiln bricks. Clearly in respect of the drying of articles such as bricks on a commercial scale a more robust adaptation of the FIG. 1 equipment is bound to be necessary. Thus the bellows 8 and 9 could conveniently be replaced by rigid ducts possibly and probably preferably of steel or the like. Buffers 10 would generally be unnecessary with the duct being movable relative to the train to allow for the removal and replacement of conveyances therein. It may be preferred to have much of the equipment adjacent to station 3 movable with the associated duct to facilitate the manipulation of the conveyances and in this case a certain telescopic characteristic may have to be introduced into return duct 5.

Many more examples of the invention exist each differing from the other in matters of detail but in no way departing from the essentials of the invention as set out in the consistory clauses and in the above description. The invention is directed to the method, to the apparatus required for exercising the method and to the novel trolleys employed therein.

Virtually all the drawbacks inherent in separate tunnels made of bricks, blocks, concrete or the like are eliminated or at least largely minimised and it is the applicant's belief that a conventional process which is time-wasteful to a degree will be materially improved upon by the method and equipment of the invention.

It will be understood that the word 'conveyance' is used in this specification to signify a container for the articles being dealt with in the process which itself or indirectly provides wheels or skids or the like for enabling the container to be employed as envisaged in the process. The invention is also intended to cover an arrangement where the containers are located on a conveyor.

The building of drying tunnels requires careful planning in laying out and building since preparation and packing rooms and the like must be cited accordingly. Where fixed tunnels are involved careful allowance must be made in respect of future possible development. The arrangements of the invention are peculiarly suitable for changes in their locality since as a rule very little extra work will be called for in shifting the apparatus from one location to another.

I claim:

1. Apparatus for subjecting commodities to treatment through contact with fluid media including a plurality of movable conveyances having walls and being arranged so as to form a conveyance train which forms a part of a single endless fluid conveying duct, having walls and opposite ends, with the walls of said part of said duct formed by the walls of said conveyances, in which the treatment to which the commodities is to be subjected takes place with fluid passing progressively through the conveyances forming the conveyance train, a fluid inlet station means and a fluid outlet station means at opposite ends of the conveyance train and between which the conveyance train is located, and a circulating duct which links the outlet station to the inlet station as a portion of the endless duct.

2. Apparatus according to claim 1, wherein said conveyance train forms a substantially linear portion of said endless fluid conveying duct.

3. Apparatus according to claim 1, wherein the circulating duct includes means for treating the fluid en route from the outlet duct to the inlet duct.

4. Apparatus according to claim 1, wherein at least one of the stations is expandable and retractable to facilitate the removal of a conveyance from its position as part of the endless duct.

5. Apparatus according to claim 4, wherein means is provided for advancing at least one conveyance from the outlet station towards the inlet station.

6. Apparatus for subjecting commodities to treatment by contact with fluid media, said apparatus including an endless duct means for conveying said fluid media, said duct means including as a part thereof a plurality of conveyance means having walls forming a portion of said duct means, said conveyance means for containing said commodities therein during said treatment, said conveyance movable in a direction opposite the direction of travel of the fluid media, said duct means including a fluid inlet station means and a fluid outlet station means, said conveyance means located between said fluid inlet station means and said fluid outlet station means, circulating duct means which links the outlet station means to the inlet station means as a portion of said endless duct means, and means to pass said fluid media through said fluid inlet station, said plurality of conveyance means, and said fluid outlet station to contact said commodities during passage through said conveyance means.

7. Apparatus according to claim 6, wherein said circulating duct means includes treatment means for treating the said fluid media between said outlet station means and said inlet station means.

8. Apparatus according to claim 6, wherein at least one of said station means is expandable and retractable to facilitate the removal of a conveyance means from its position as part of said endless duct means.

9. Apparatus according to claim 6, wherein said apparatus additionally includes advancing means for advancing at least one conveyance means from said outlet station means towards said inlet station means.

10. A method of treating commodities by contact with a fluid media in an apparatus, said apparatus comprising a plurality of movable conveyances having walls and arrangeable so as to form a conveyance train which forms part of a single endless fluid conveying duct having walls and opposite ends, with the walls of said part of said duct formed by the walls of said conveyances, a fluid inlet station means and a fluid outlet station means at opposite ends of the conveyance train and between which the conveyance train is located, and a circulating duct which links the outlet station to the inlet station as a portion of said endless duct, said method comprising the steps of placing said commodities in said conveyances, arranging said conveyances to form said conveyance train, passing said fluid media from said inlet station means to said outlet station means through said conveyance train, removing at least one conveyance adjacent the inlet station means from position as part of said duct once the commodities in said conveyance having been sufficiently treated, advancing said conveyance train towards the inlet station means, and coupling the required number of freshly laiden conveyances into said train adjacent said outlet station means to reform said duct.

11. The method according to claim 10 wherein the train of conveyances is linked into and forms part of a generally endless duct, with treating fluid being circulated from the outlet station to the inlet station.

12. A method of treating commodities by contacting same with fluid media in apparatus including an endless duct means for conveying said fluid media, said duct means including as part thereof a plurality of conveyance means having walls forming a portion of said duct means, fluid inlet station means and fluid outlet station means, said conveyances movable in a direction from said fluid inlet station means towards said fluid outlet station means, said conveyance means located between said station means, circulating duct means which links the outlet station means to the inlet station means as a portion of said endless duct means, and means to pass said fluid media through said fluid inlet station, said plurality of conveyance means, and said fluid outlet station to contact said commodities during passage through said conveyance means, said method comprising the steps of placing said commodities in said conveyance means, arranging said conveyance means to form said endless duct means, passing said fluid media from said inlet station means to said outlet station means, removing at least one conveyance adjacent the inlet station means from position as part of said endless duct means once the commodities in said conveyance means have been sufficiently treated, advancing the remainder of said conveyance means between said inlet station means and said outlet station means toward said inlet station means, and coupling the required number of freshly laiden conveyance means into said endless duct means adjacent said outlet station means to reform said endless duct means.

* * * * *

UNITED STATES PATENT AND TRADEMARK OFFICE

CERTIFICATE OF CORRECTION

PATENT NO. : 4,100,682

DATED : July 18, 1978

INVENTOR(S) : John Henry Corrigan

It is certified that error appears in the above-identified patent and that said Letters Patent are hereby corrected as shown below:

The Foreign Application Priority Data Information reads April 10, 1977 [ZA] South Africa 77/1844. This should read April 10, 1975, [ZA] South Africa 75/1844.

Signed and Sealed this

*Twentieth* Day of *February 1979*

[SEAL]

*Attest:*

RUTH C. MASON
*Attesting Officer*

DONALD W. BANNER
*Commissioner of Patents and Trademarks*